US006639566B2

(12) United States Patent
Knop et al.

(10) Patent No.: US 6,639,566 B2
(45) Date of Patent: Oct. 28, 2003

(54) DUAL-POLARIZED SHAPED-REFLECTOR ANTENNA

(75) Inventors: Charles M. Knop, Lockport, IL (US); Robert Gunnells, Lockport, IL (US); John Myhre, Western Springs, IL (US); Greg Orseno, Lockport, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/961,064

(22) Filed: Sep. 20, 2001

(65) Prior Publication Data

US 2003/0052831 A1 Mar. 20, 2003

(51) Int. Cl.[7] ..... H01Q 13/02
(52) U.S. Cl. ..... 343/780; 343/786
(58) Field of Search ..... 343/780, 781 R, 343/786, 783; 455/129, 575

(56) References Cited

U.S. PATENT DOCUMENTS

| | | | | | |
|---|---|---|---|---|---|
| 2,822,541 | A | | 2/1958 | Sichak et al. | |
| 3,828,349 | A | * | 8/1974 | Laurenceau | 343/780 |
| 4,051,476 | A | | 9/1977 | Archer et al. | 343/700 |
| 4,349,827 | A | * | 9/1982 | Bixler et al. | 343/786 |
| 4,410,892 | A | | 10/1983 | Knop et al. | 343/786 |
| 4,447,811 | A | | 5/1984 | Hamid | 343/783 |
| 4,477,816 | A | * | 10/1984 | Cho | 343/76 |
| 5,486,838 | A | | 1/1996 | Dienes | 343/781 |
| 6,011,521 | A | | 1/2000 | Knop et al. | 343/781 |
| 6,094,174 | A | | 7/2000 | Knop et al. | 343/781 |
| 6,323,816 | B1 | * | 11/2001 | Omuro | 343/780 |

OTHER PUBLICATIONS

Knop et al, "On the Fields in a Conical Horn Having an Arbitrary Wall Impedance", IEEE Transactions on Antennas and Propagation, vol. AP–34, No. 9, Sep. 1986, pp. 1092–1098.

L. Thourel, "The Electromagnetic Horns", Antenna, 1960, pp. 255–258.

* cited by examiner

*Primary Examiner*—Michael C. Wimer
(74) *Attorney, Agent, or Firm*—Jenkens & Gilchrist, P.C.

(57) ABSTRACT

A hog-horn antenna for producing two orthogonally polarized signals. The elevation plane pattern of each signal can be made to have virtually any shape, but is typically of a substantially cosecant-squared shape. In providing for the dual-polarization capability, the hog-horn antenna is designed to produce substantially equal gains for orthogonal polarizations, either simultaneously or separately. Two techniques to substantially equate the elevation plane radiation patterns of the two polarizations include corrugating or absorber-lining the surfaces of portions of the hog-horn antenna. Azimuthal pattern control may be achieved by corrugated/absorber lined flanges.

22 Claims, 7 Drawing Sheets

DUAL-POLARIZED SHAPED-REFLECTOR ANTENNA

BACKGROUND OF THE PRESENT INVENTION

1. Field of the Invention

The present invention relates generally to antennas, and more particularly, but not by way of limitation, to an antenna for communicating two independent microwave signals being orthogonally polarized.

2. Description of the Related Art

Local multipoint distribution systems (LMDS) are used for communicating information from a central location to distributed locations. Recent developments of data communication have demanded that high speed data communication be available between the distribution locations from the central location. For example, a new telecommunications company may wish to serve many customers without constructing cable to the premises of customers or renting existing cable from the current local telecommunications company. From a central antenna location, communication with multiple customers is possible. Use of a local multipoint distribution system generally has up to a three to five mile transmission range and may employ wavelengths of about one-centimeter or less.

In addition to LMDS systems, multichannel multipoint distribution systems (MMDS) are utilized to communicate, for example, television channels or data information from a central location to multiple distributed locations. MMDS systems have a longer range of communication, generally 35 miles, than LMDS systems, and employ wavelengths of about 15 cm.

While it is possible to create distribution channels for the LMDS and MMDS systems using fiber optic cables, installation of optical fiber cables is difficult and expensive due to construction and legal fees. To avoid the costs of using optical fiber or other cables, recent developments of wireless communications providing high speed service have caused LMDS systems to be preferred. Such wireless communications include using microwaves such as 30 GHz (i.e., wavelengths of about one-centimeter or less) and higher. This recent move toward using LMDS systems, however, have required the development of infrastructure, including special antennas, to support point-to-multipoint (and reverse) communication.

It is desirable to have constant power density received at the ground level without regard to the relative distance from the antenna. Because power density radiated from an antenna drops as $1/R^2$, where R is a range variable, it is therefore desirable to produce a cosecant-squared antenna radiation pattern in the elevation plane. One type of antenna that is capable of producing a cosecant-squared antenna radiation pattern in the elevation plane, and currently used in LMDS systems is a reflector antenna known as a hog-horn antenna having a specially-shaped reflector (situated between two parallel plates and illuminated with an offset feed horn). The reflector is generally not parabolic. For the LMDS systems, the antenna is generally mounted on a building or a tower to provide coverage over a ground sector or region.

As the antenna is mounted (see FIG. 7) at a height H, the following equation may be applied: $\sin(\theta)=H/R$, where $\theta$ is the angle measured from the antenna to the ground from the horizon. As $\theta$ varies from the horizon to approximately 45 degrees or less, R becomes smaller as 45 degrees is approached. Therefore, to produce an antenna radiation pattern that has constant power density at ground level, an antenna radiation pattern having a distribution of $R^2$ will substantially negate the $1/R^2$ decrease in power density. A simple geometrical equation, $R^2=1/\sin^2\theta=\csc^2\theta$, thus shows that to produce an antenna having an elevation plane pattern that has an $R^2$ distribution, a cosecant-squared elevation radiation pattern is desired.

As understood in the art, a hog-horn antenna can be made using a feed horn and a specially shaped (non-parabolic) reflector that produces a cosecant-squared antenna radiation pattern. Note: hog-horn antennas with a parabolic reflector are also used, but produce a pencil beam elevation plane pattern, not a cosecant-squared type. A pencil-beam pattern is not useable for cosecant squared applications because of the resulting narrow beam width in the elevation pattern and lack of elevation null filling. There are specific uses for such an antenna, such as where coverage of a very narrow strip is desired.

In the azimuth patterns, it is desirable to restrict the signal to a specific angular pattern. This sector antenna allows for reuse of the same frequencies from the same location. For example, two 90 degree sector antennas may be mounted in opposing directions with negligible, if any, interference.

While the ability for a hog-horn antenna with a specially-shaped (e.g., non-parabolic) reflector to produce a cosecant-squared antenna radiation pattern has been known for years, these antennas have been limited by their ability to communicate only in a single polarization (i.e., either horizontal or vertical polarization). By having communication capabilities over only a single polarization, bandwidth is limited to half of the bandwidth that is possible by using both polarizations. To use both polarizations in a present day communication system desiring the cosecant-squared antenna radiation pattern of the hog-horn antenna, two antennas are typically utilized—each one configured in a different polarization. The principles of the present invention allow for use of both polarizations, either separately or simultaneously, by a single, hog-horn antenna.

DETAILED DESCRIPTION OF THE DRAWINGS

The principles of the present invention will now be described more fully hereafter with reference to the accompanying drawings, in which exemplary embodiments of the invention are shown. This invention may, however, be embodied in many different forms and should not be construed as limited to the embodiments set forth herein; rather, these embodiments are provided so that this disclosure will be thorough and complete, and will fully convey the scope of the principles of the present invention to those skilled in the art.

To overcome the limitation of a shaped-reflector hog-horn antenna operable only in a single polarization over microwave frequencies, the principles of the present invention provide for a hog-horn antenna, (which as usual) includes a feed horn that is offset, i.e., not blocking an aperture of the antenna, and directed to a specially-shaped reflector, where the feed and the parallel plates are both capable of supporting dual-polarization. The specially-shaped antenna produces a substantially cosecant-squared radiation elevation plane pattern. The side "wings" control the shape of the azimuth (horizontal) plane pattern.

In providing for the dual-polarization communications capability, the subject hog-horn antenna is designed to substantially produce equality of gain for orthogonally polarized (e.g., horizontal and vertical) microwave signals from the hog-horn antenna. One technique to substantially equate the polarizations is to make the feed horn to be the side walls of the excitation "flat-cone", where the narrow walls (those perpendicular to the parallel plates) are appropriately corrugated. Another technique to substantially equate the polarizations is to apply an absorber lining to these narrow walls. Other equivalent microwave tapering techniques may be utilized to substantially equate the power density or gain of the orthogonally polarized microwave signals.

A waveguide coupled to the feed horn capable of supporting both polarizations of the microwave signals, such as WS-28 in the 30 GHz band, may be utilized when combined with an appropriate adapting interface as understood in the art. It should be understood that WS-28 is a substantially square waveguide having a square dimension of 0.28 inches. However, as the antenna is capable of operating in a single or dual polarization mode, a single polarization waveguide, such as WR-28, may be utilized. To control the azimuth distribution of the antenna radiation pattern, a "wing" or flange extension coupled to the parallel plates extending from the aperture of the antenna, may be added. The flange extensions also may be corrugated or absorber-lined, or equivalent, to maintain the substantial equality of the orthogonal polarizations.

Figure 1C:
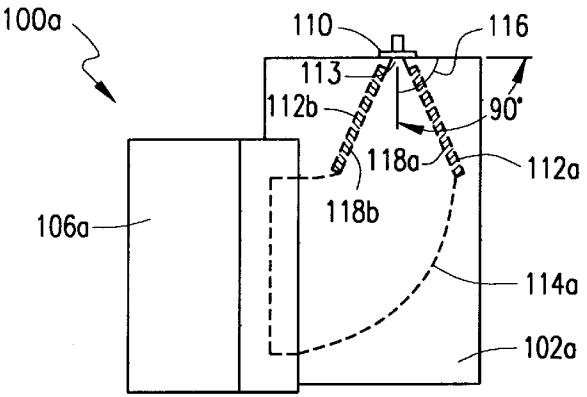
FIGS. 1A–1F illustrate different views of an exemplary hog-horn antenna providing dual-polarization capability.
Figure 1A:
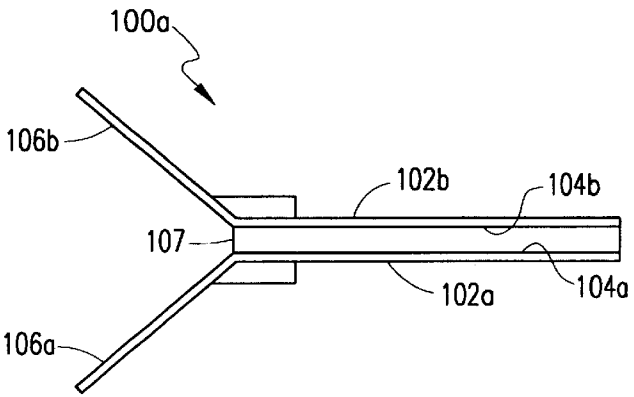

FIG. 1A is a top view of an exemplary hog-horn antenna 100 for producing a cosecant-squared radiation pattern. Two plates 102*a* and 102*b* (collectively 102) form the side walls of the antenna 100. The plates 102 have substantially parallel or opposing inner surfaces 104*a* and 104*b* (collectively 104). It should be understood that being substantially parallel includes: (i) being exactly parallel, (ii) having discontinuities in the surfaces that are not exactly parallel, or (iii) being not exactly parallel due to mechanical tolerance limitations. Alternatively, a slight taper angle between the plates may be utilized, and still meet a cross-polarization specification. Flange extensions 106*a* and 106*b* (collectively 106) are coupled to the plates. The plates 102 are open at one end to form an internal aperture 107 of the antenna 100 for microwave communication.

Figure 1D:
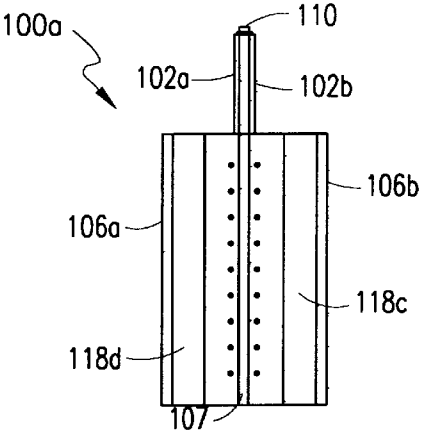
Figure 1B:
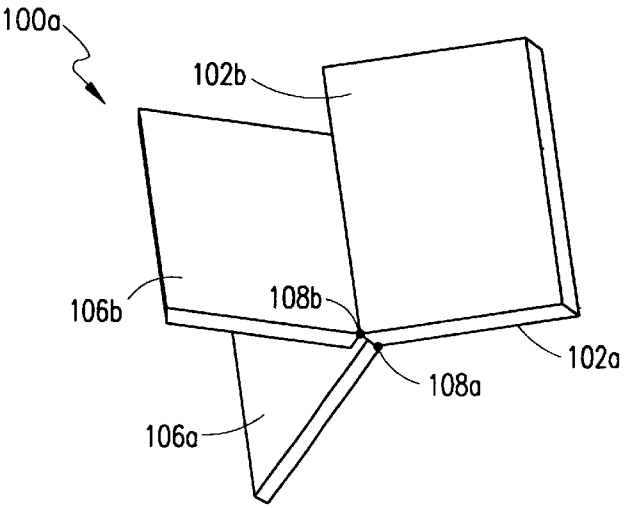

FIG. 1B is an isometric view of the antenna 100. As shown, the flange extensions 106 are coupled to the plates 102. In one embodiment, hinges 108*a* and 108*b* (collectively 108) may be utilized to couple the flange extensions 106 to the plates 102. Alternatively, weldments, bolts, screws, adhesives, or other suitable hardware coupling techniques may be used to couple the flange extensions 106 to the plates 102. By utilizing hinges 108 or other rotatable mechanism, however, the angle between flange extensions 106 can be adjusted to achieve specified/desired azimuthal sector or region coverage. This angular change between the flange extensions 106, in conjunction with the flange extensions 106 being lengthened or shortened to control the azimuthal radiation pattern so as to realize the desired sector coverage. The flange extensions 106 may have extender elements that may be telescoped outward or easily attachable and removable for modifications to the sector coverage area. It may be desirable that the top, bottom, or front edges of the flange extensions 106 that couple to the plates 102*a* and 102*b* not be exactly parallel for fine adjustment of the elevation plane shaping.

FIG. 1C is a side view of the exemplary antenna 100. A substantially square waveguide feed (WS-28 in this example) 110 is disposed relative to and having an aperture directed into the space between two surfaces 112*a* and 112*b* (collectively 112) that define the feed horn. The surfaces 112 may be conductive and/or absorber-lined. The surfaces 112 have a minimum spacing 113 of a half-wavelength at the minimum operating frequency. For the instant example of FIG. 1, a spacing of approximately 0.28 inches is utilized to accommodate frequencies that have a half-wavelength ($\lambda/2$) of 0.28 inches or less.

The waveguide feed 110 may be a WS 28 waveguide feed, which has a substantially square aperture to support dual-polarized signals by means of an ortho-mode transducer (OMT) connected to the WS-28 waveguide, for example. The OMT may be a WS-28 square waveguide having perpendicular input ports to accommodate both orthogonally polarized signals into the waveguide without significant interaction between them. Alternatively, the waveguide feed 110 may have added to it a waveguide taper to transition from the WS-28 to a rectangular waveguide feed, such as a WR-28 having dimensions of approximately 0.28 by 0.14 inches. This rectangular waveguide feed allows only a single polarized signal to be accommodated (the polarization of which may be changed by merely rotating the taper 90 degrees when attaching it to the WS-28). This single polarization (either vertical or horizontal) antenna configuration using the taper component allows the antenna to later support future upgrades to simultaneous dual-polarization operation by simply removing the taper element and substituting a substantially square waveguide with OMT to the waveguide feed 110. It should be understood that other sized waveguide feeds may be utilized to support different frequency ranges. As understood in the art, the dimensions should be chosen so that only the $TE_{10}$ and $TE_{01}$ modes propagate. Generally, if the configuration of the antenna is properly designed and constructed, cross-polarization discrimination between the orthogonal polarizations is at least in the range of −30 dB to −20 dB over the entire pattern range of ±180 degrees in elevation or azimuth.

The waveguide feed 110, which may be flush with or extend between the minimum spacing 113 of the surfaces 112, is directed toward a specially-shaped reflective surface 114*a* at an offset angle 116. The offset angle 116 is 90 degrees for the exemplary embodiment of FIG. 1C. The reflective surface 114*a* is shaped as a function of the offset angle 116. The flange extension 106*a* are coupled to the plates 102.

Figure 1E:
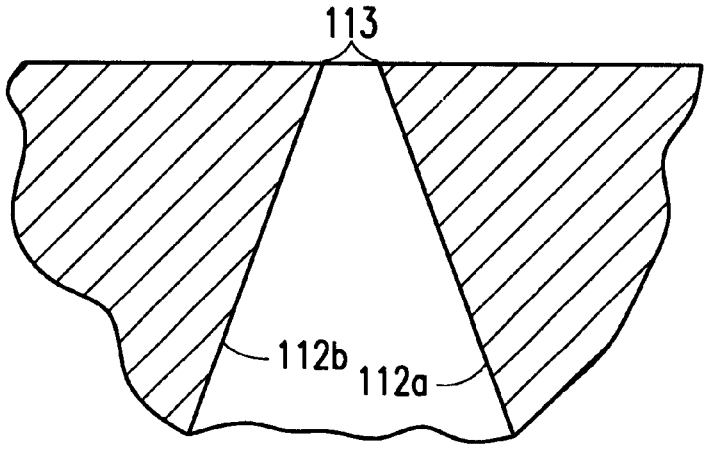
Figure 1F:
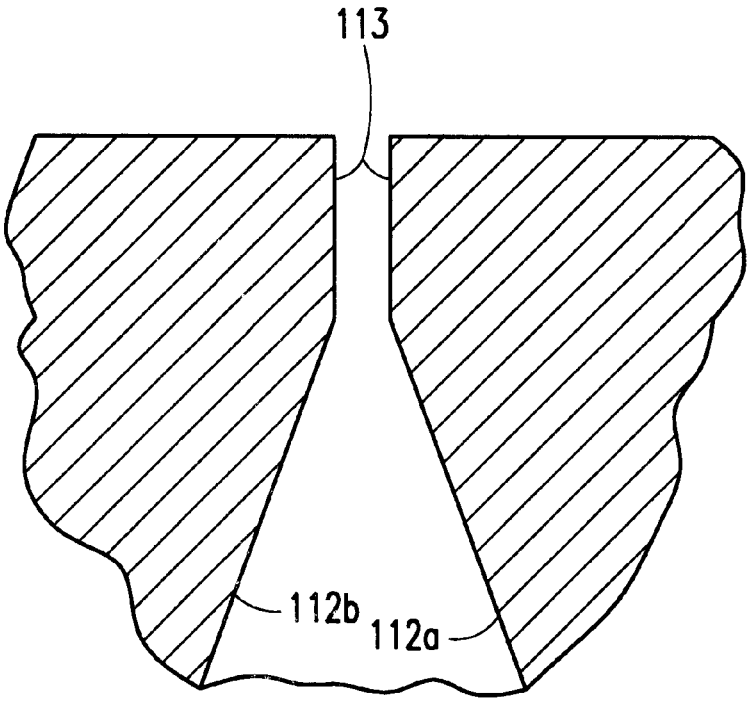

FIGS. 1E and 1F include a detailed view of two embodiments for the minimum spacing 113 of the surfaces 112. In FIG. 1E, the waveguide feed 110 (not shown) may be flush with the feed horn defined by the surfaces 112. In FIG. 1F, the feed horn defined by the surfaces 112 may extend into a narrow, discrete length portion having a minimum spacing 113.

Referring again to FIG. 1C, the surfaces 112 defining the narrow walls of the antenna feed horn are substantially the same length for the offset case of 90 degrees and are unequal for an offset angle other than 90 degrees (i.e., the length of the narrow walls is determined as a function of the offset angle 116). Further, the surfaces 112 are corrugated or absorber-lined as depicted by the shaded surfaces 118*a* and 118*b* (collectively 118). Typically, these surfaces 118 are flush with the surfaces 112 located closest to the waveguide feed 110 (i.e., at the throat of the feed horn) so that minimal discontinuity, if any, is created, thereby avoiding the introduction of standing wave ratio/higher-order mode effects. However, non-flush corrugated or absorber-lined surfaces may alternatively be considered a viable option. In practical terms, the surfaces 112, and other surfaces of the antenna 100*a*, may be a plastic or other non-conductive material that is coated with a conductive material, such as metal.

The use of a corrugated surface to produce a tapered perpendicular electric field distribution (i.e., virtually zero at the walls and maximum half way between the walls) is understood in the art and may be formed by substantially square or rectangular shaped grooves/teeth. This tapering of the electric field consequently tapers power density in the same manner. Alternatively, the corrugations may be any other geometric shape, including diamond and triangular shaped (although these are not as effective as the above) to provide for the above tapering of the electric field between the walls. A corrugation having approximately six or more teeth plus grooves per wavelength may be utilized. Additionally, the grooves may be periodic or aperiodic. If a higher frequency is to be communicated by the antenna, shorter and closer spaced ridges may be utilized. For example, if the communication frequencies are doubled, the spacing of the corrugation elements are reduced by 50 percent.

Absorber-lined surfaces are also known in the art. For the instant case, an equivalent to AAP-ML-73 formerly produced by Advanced Absorber Products Inc., Poplar Street, Amesbury, Mass., subsequently purchased by Arlon may be utilized. Alternatively, an absorber known as Eccofoam FS produced by Emerson Cumming located in Canton, Mass. 02021 may be utilized. Further information regarding microwave absorber material is provided in the paper entitled, "On the Fields in a Conical Horn Having an Arbitrary Wall Impedance", IEEE Transactions on Antennas and Propagation, Vol. AP-34, No. 9, pp. 1092–1098, September 1986, Knop, C. M.; Cheng, Y. B.; and Ostertag, E. L., which is incorporated herein by reference.

In understanding how the above corrugated/absorber lined surfaces 118 taper the electric field, consider two parallel conductive plates of spacing D. An electric field may be propagated between the surfaces of the conductive plates. If the E-field of the electric field is perpendicular to the plates, then the electric field passes between the plates, and the amplitude of the electric field is uniform between the plates. If, however, the polarization of the electric field is reversed such that the E-field is parallel to the plates, the electric field passes between the plates, but has a cosine distribution between the plates as the electric field at the plates drops to zero due to the E-field being tangent to the surface of the plates. Therefore, to create a similar response in both of the orthogonal polarizations, for the case of the E-field being perpendicular to the parallel conductive plates, the plates must be corrugated/absorber lined. Note: It is preferable that $D/\lambda \geq 3$ for absorber lining to minimize ohmic loss, where D is the distance between the plates.

FIG. 1D is a front view of the antenna 100. The internal aperture 107 is shown as an opening between and along one edge of the plates 102. The flange extensions 106 are coupled to the plates 102. The flange extensions 106 may have microwave tapering surfaces 118*c* and 118*d* (i.e., corrugated or absorber-lined) for shaping an E-field that is perpendicular to the flange extensions 106.

The azimuthal antenna radiation pattern may be modified by simply altering the flange extensions 106 to have a different angle, be shorter or longer, and/or change the corrugation or absorption-lining. It should be understood that the function of the corrugated and absorber-lined surfaces function in a manner similar to the microwave tapering surfaces 118 of the feed horn. In the absorber-lined case, the surfaces are separated by at least approximately three wavelengths of the microwave signals.

To date, hog-horn antennas have flange extensions having a maximum length of one or two wavelengths due to the sector coverage being, in general, 60 or 90 degrees. However, with the hog-horn antenna according to the principles of the present invention, sector coverage may be below 60 degrees. With sector or region coverage below 60 degrees, approximately 30 degrees or less, the flange extensions 106 may be, for sharply defined pattern drop-offs (i.e., a sector that has a very rapid signal fall-off outside of the sector boundaries), up to fourteen wavelengths or longer, which is a technique previously unutilized in the art for the reason that sharp sectors have not been necessary.

Figure 2A:
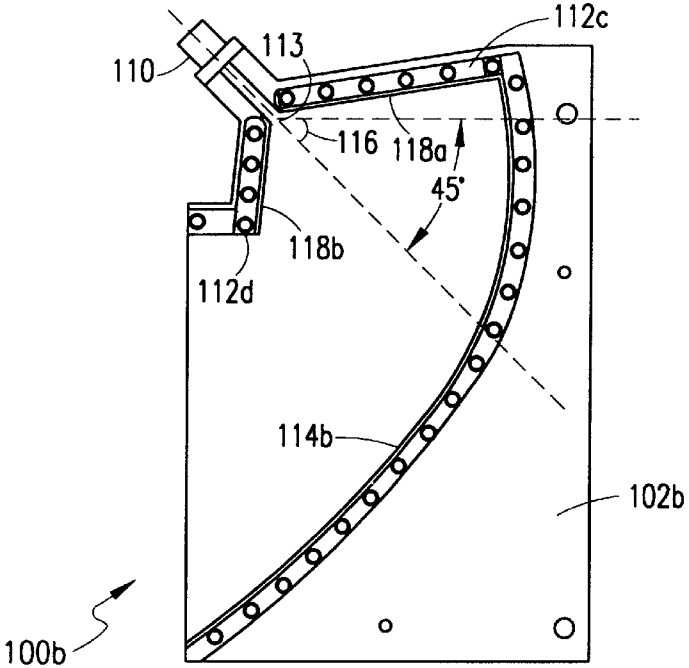
FIGS. 2A–2C illustrate side, front, and exploded views, respectively, of another exemplary hog-horn antenna according to the principles of the present invention.

FIG. 2A is a side view of another exemplary hog-horn antenna 100*b*. One difference between the hog-horn antenna 100*a* of FIG. 1A and that of FIG. 2A is that the exemplary offset angle 116 is 45 degrees rather than 90 degrees, respectively. As shown, the surfaces 112*c* and 112*d* are not the same length, which is determined as a function of the offset angle 116. The shaped reflective surface 114*b* is shaped differently from the non-parabolic reflective surface 114*a* since its shape is a function of the offset angle 116 and length of the surfaces 112*c* and 112*d*. Despite the change in offset angle 116 (90 to 45) of the waveguide feed 110, the new shaped surface is such as to still provide the same type of elevation plane pattern (i.e., cosecant-squared) but now the antenna height is reduced. For the case of the surfaces 112*c* and 112*d* being absorber-lined, the spacing between the absorber linings of the two surfaces is about three-wavelengths of the microwave signals. Also, symmetry is maintained between the absorber-lined surfaces. For the corrugated case, the corrugations may start directly at the input waveguide—usually slightly larger to obtain a good standing wave ratio.

Figure 2B:
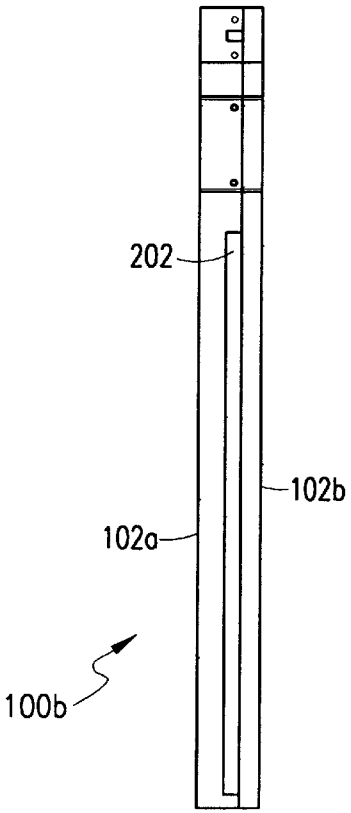

FIG. 2B is an exemplary front view of the hog-horn antenna 100*b*. As shown, a cavity 202 of the antenna is defined by the plates 102 and the surfaces 112 defining the feed horn. Alternatively, the cavity 202 may be formed by machining, casting, or molding a solid piece of conductive or non-conductive material. If multiple components are utilized to form the antenna 100*b*, then the components are joined together by techniques known to those skilled in the art.

Figure 2C:
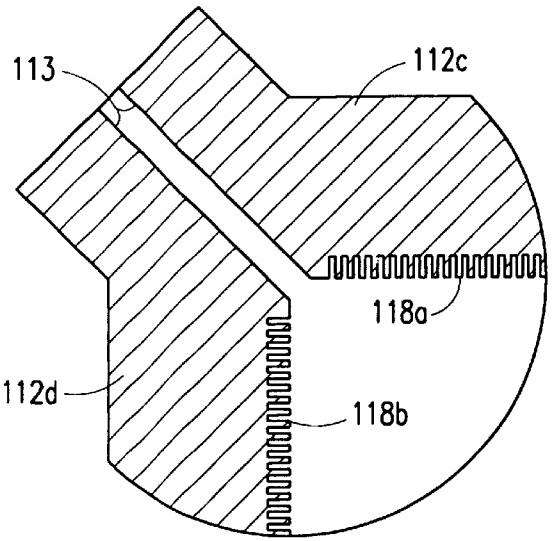

FIG. 2C is an exemplary exploded view of the opening of the feed horn defined by the surfaces 112*c* and 112*d*. As shown, the minimum separation 113 is the distance leading into the horn located between the surfaces 112*c* and 112*d*, which is at least about half of the wavelength of the microwave signals. The corrugations 118*a* and 118*b* are shown to be machined into the surfaces 112*c* and 112*d*, respectively, and need not be separated by approximately three wavelengths of the microwave signals as would be the case of an absorber-lining.

Figure 3:
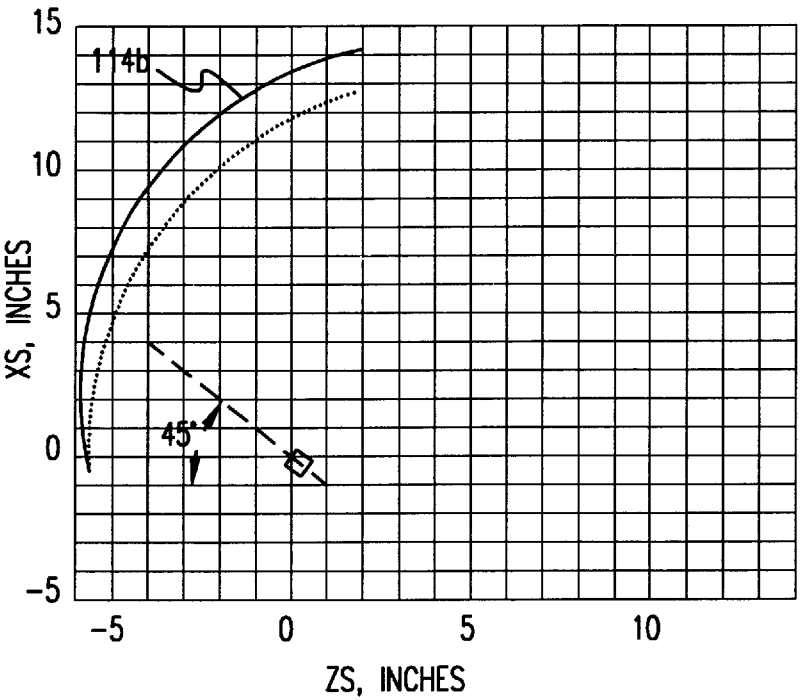
FIG. 3 provides a graph including the shape of the hog-horn antenna of FIGS. 2A–2C relative to a "parent" parabola.

FIG. 3 is graph 300 showing an exemplary shape of the reflective surface 114*b* of the antenna 100*b*. The waveguide feed 110 is offset by 45 degrees. The shape of the reflective surface 114*b* was derived from a "parent" parabola 302. It should be understood that the reflective surface 114*b* has a shape that produces a substantially cosecant-squared elevation plane radiation pattern. However, the principles of the present invention may be alternatively applied to a parabolic surface, which forms a "pencil" beam, in the elevation plane, if so desired. Also, virtually any pattern shape can be realized by appropriate shaping as understood in the art.

Figure 4:
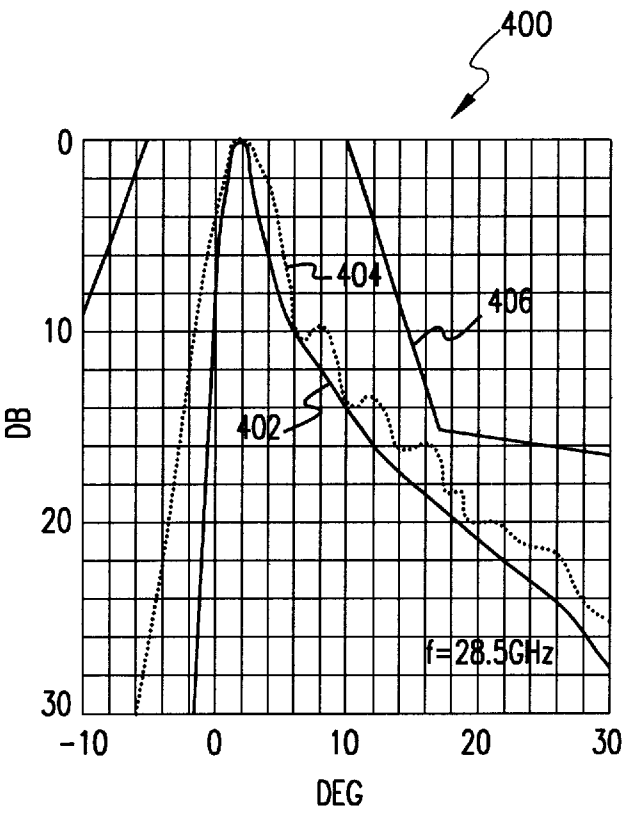
FIG. 4 provides a graph of predicted elevation-plane antenna radiation patterns of the hog-horn antennas of FIGS. 2A–2C.

FIG. 4 is a graph 400 of a predicted elevation plane antenna radiation patterns produced by two slightly different reflective surfaces 114*a* and 114*b*. As shown, the radiation pattern 402 has slightly better reduced or suppressed side lobes as compared with the radiation pattern 404 (although both are acceptable cosecant-squared type patterns). In fact, either of the above hog-horn antennas can be referred to as "null-filler" (i.e., reducing/eliminating radiation pattern nulls) antennas. As shown, the radiation pattern 402 has a narrower beam than the radiation pattern 404 over the given frequency range and angle, but both are below a radiation profile requirement curve 406.

Figure 5A:
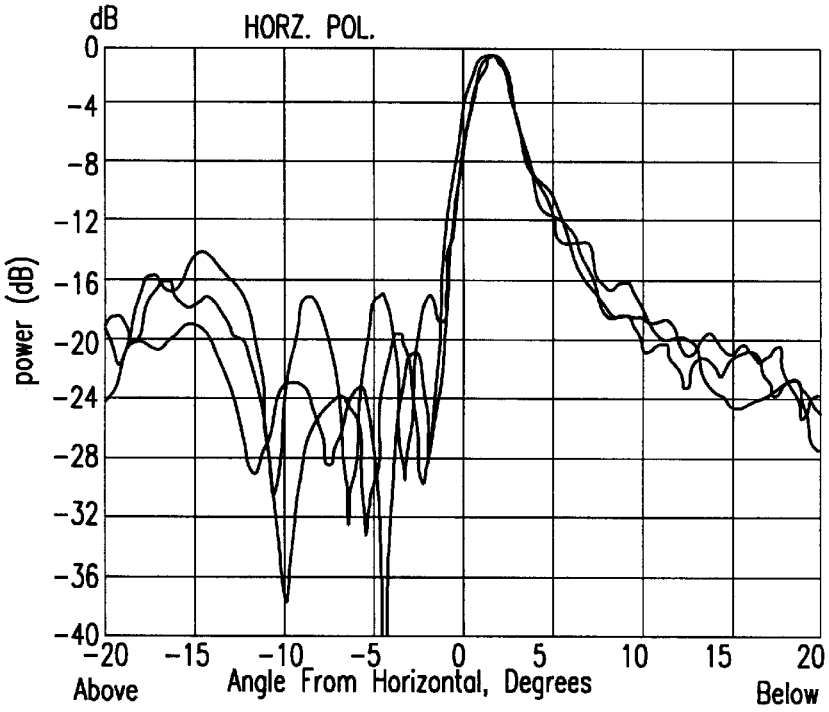
FIGS. 5A and 5B provide measured elevation-plane radiation patterns for horizontal and vertical polarizations of the hog-horn antenna of FIGS. 2A–2C.
Figure 5B:
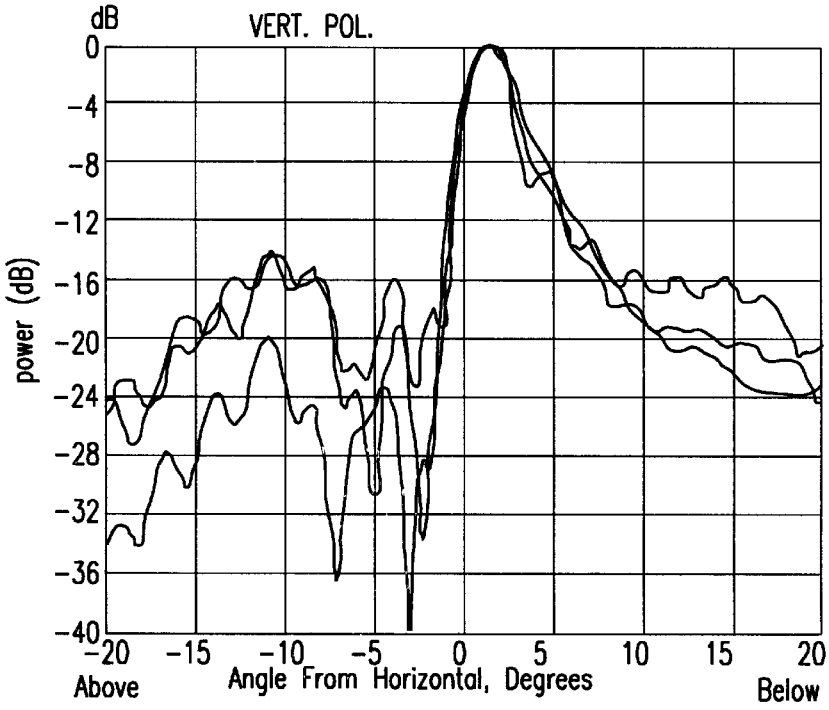

FIGS. 5A and 5B are measured elevation plane radiation patterns for orthogonally polarized microwave signals from the hog-horn antenna 100*b*. As shown, the horizontally and vertically polarized radiation patterns are substantially the same. Because of the similarity of the two polarization radiation patterns, the antenna 100*b* is capable of communicating two independent microwave signals being dual polarized (or dual-polarized microwave signals) either simultaneously or separately, as discussed above. In determining the similarity of the two polarization radiation patterns, a comparison of the gain at the main lobe and for any angle below the horizon may be performed. In some instances a symmetrical or even a cosecant-squared pattern on both sides of the main beam (i.e., towards the sky and ground) may be desirable. Further, comparison of the power density levels of the side lobes at each angle may be performed. If the power density at the peak of the main lobe is within approximately +/−0.5 dB and within approximately +/−0.5 degree at the 3 dB point below the peak, and several dB about 20 degrees from the main lobe, then it may be said that the antenna is capable of producing substantially equal patterns in both polarizations (simultaneously or separately).

Figure 6:
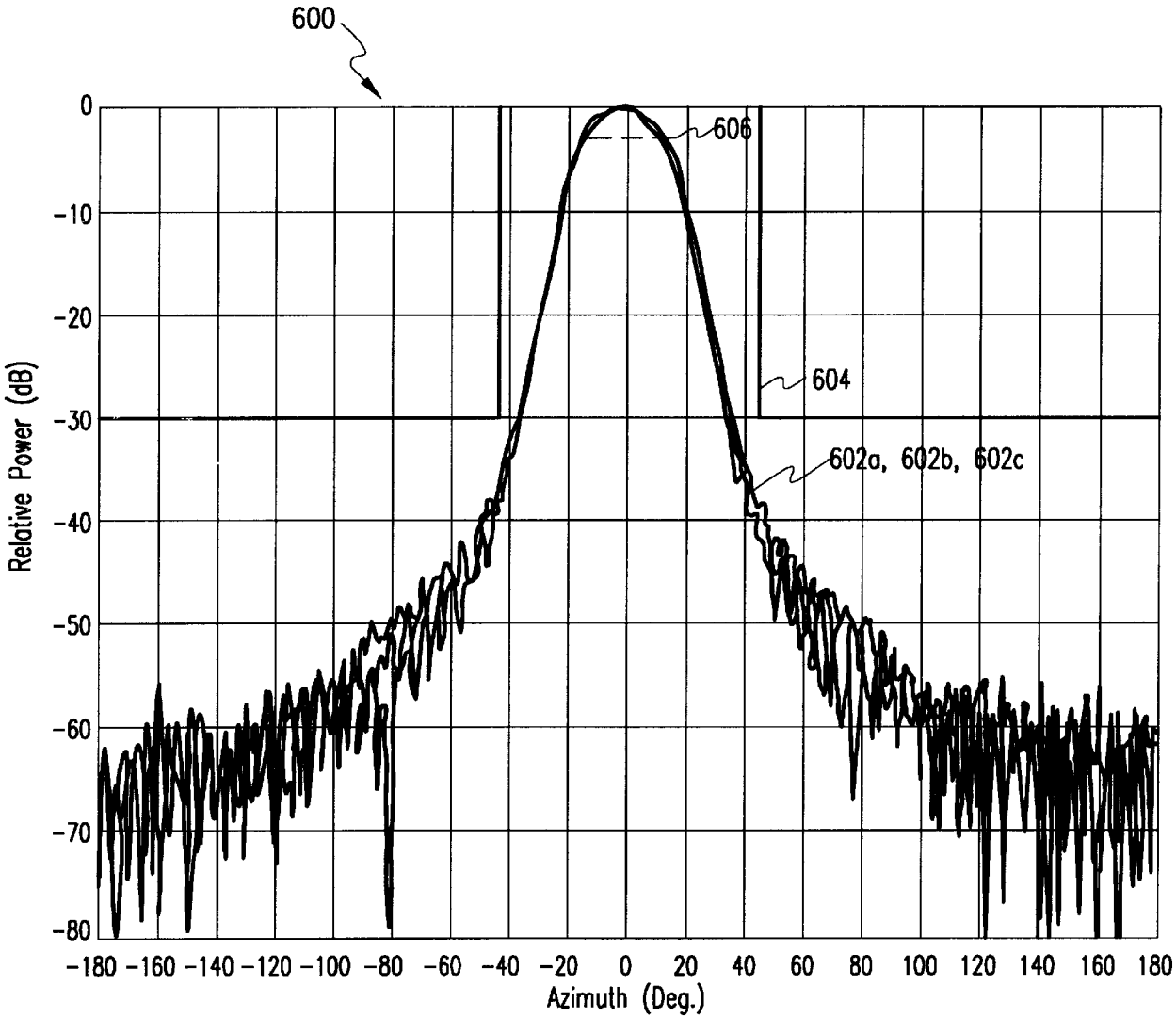
FIG. 6 provides actual measurements of an exemplary 30 degree azimuthal (horizontal) plane sector horn antenna employing azimuth-pattern shaping "wings" illustrated in FIGS. 2A–2C.

FIG. 6 provides a graph 600 showing actual measurements of radiation patterns 602*a*, 602*b*, and 602*c* (collectively 602) at three frequencies, in the azimuthal plane of the hog-horn antenna 100*b* for a 30 degree azimuthal sector coverage case. An azimuth radiation pattern envelope 604 provides criteria to be satisfied for the measured radiation patterns 602 to satisfy. A 3 dB line 606 may further be used to form criteria for the beam width of the radiation patterns 602 (here 30 degrees). As shown, the radiation patterns 602 are well balanced on both sides of boresight.

Figure 7:
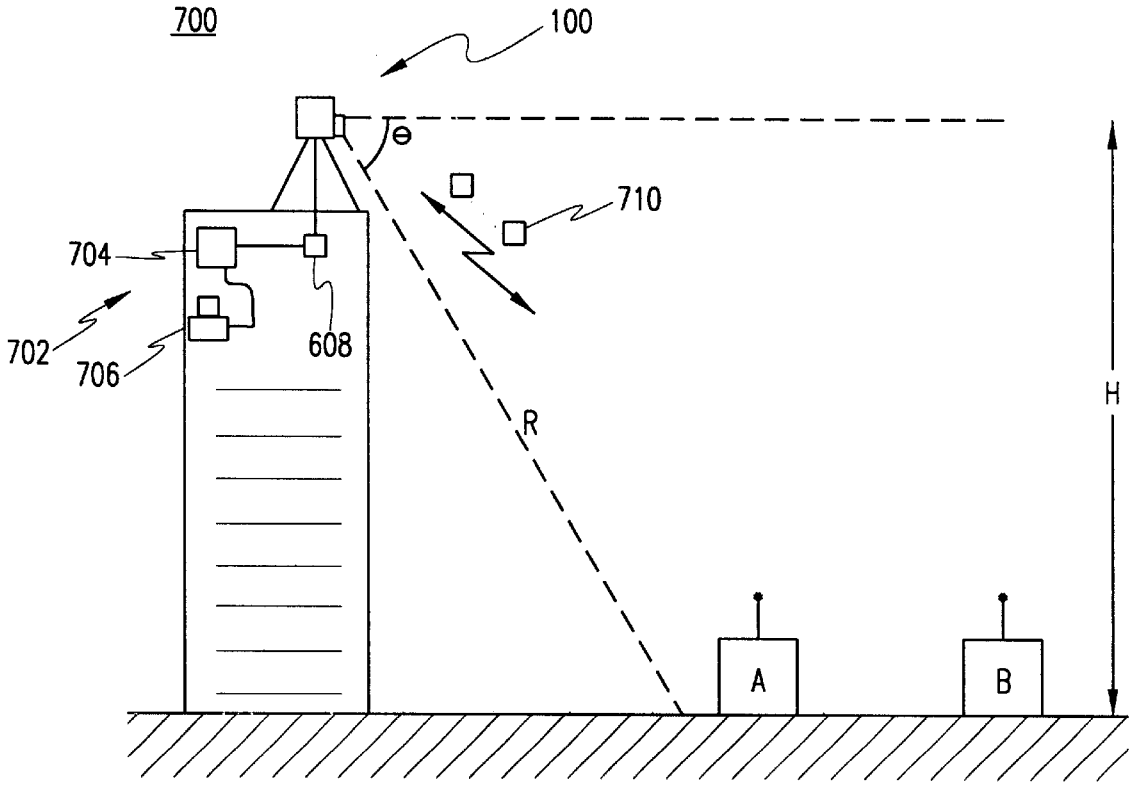
FIG. 7 is an exemplary communications system that utilizes the principles of the present invention.

FIG. 7 is an exemplary communication system 700 that utilizes the hog-horn antenna 100. The communication system 700 may be an LMDS system operated by a telecommunications service 702 and communicates to customers A and B. The communication system comprises a server 704 that interfaces with a personal computer or terminal 706 via a local area network or other network, such as a wide area network.

In communicating from the service company 702, the server 704 communicates information, including voice and/or data, to a transceiver 708. In the transmit mode, the transceiver 708 modulates the data onto a microwave signal to be radiated by the antenna 100 to subscriber A and B. However, typically special codes in the signal direct the information to only one subscriber, thus preventing subscriber B from receiving information intended for subscriber A. If the transceiver 708 is configured to communicate in a dual-polarization mode, then the antenna transmits the signal as two independent microwave signals being orthogonally polarized. Otherwise, the antenna transmits one signal either as a horizontal or vertical polarized signal. As shown, the data transmitted may be in packets 710 or continuous.

The previous description is of exemplary embodiments for implementing the principles of the present invention, and the scope of the invention should not necessarily be limited by this description. The scope of the present invention is instead defined by the following claims.

What is claimed is:

1. An antenna for communicating two independent microwave signals being orthogonally polarized from a first point to multiple points, said antenna comprising:

a plurality of conductive plates being substantially parallel, and separated by a distance of at least one-half a wavelength of the microwave signals, an opening between an edge of said conductive plates providing for transmission of the microwave signals;

a reflective surface coupled to said plurality of conductive plates, and disposed in reflective relation to the opening;

a plurality of surfaces coupled to edges of said plurality of plates, said plurality of surfaces forming wide and narrow apertures, the narrow and wide apertures directed toward said reflective surface;

a substantially square waveguide feed disposed in relation to the narrow aperture, and used for supplying the microwave signals through the narrow aperture; and means, associated with said plurality of surfaces, for tapering the power density of the microwave signal.

2. The antenna according to claim 1, wherein said means for tapering is either coupled to or formed on said plurality of surfaces.

3. The antenna according to claim 1, wherein said means for tapering is separated by a distance of at least approximately three wavelengths of the microwave signals.

4. The antenna according to claim 1, wherein said reflector surface is shaped to produce a predetermined shaped elevation-plane radiation pattern.

5. The antenna according to claim 4, wherein the predetermined elevation-plane radiation pattern is of a substantially cosecant-squared shape.

6. The antenna according to claim 1, further comprising a plurality of flange extensions coupled to said conductive plates.

7. The antenna according to claim 6, wherein said plurality of flange extensions are corrugated or absorber-lined.

8. The antenna according to claim 1, wherein said surfaces are conductive.

9. The antenna according to claim 1, wherein said plurality of surfaces are formed of a single component of a monolithic material.

10. A method for manufacturing an antenna for communicating two independent microwave signals being orthogonally polarized, the method comprising:

arranging a pair of conductive plates to be substantially parallel and at a separation distance of at least one-half a wavelength of the microwave signals, an aperture-opening between an edge of said conductive plates providing for transmission of the microwave signals;

coupling a reflective surface to said pair of conductive plates, the reflective surface being disposed in reflective relation to the aperture-opening;

mounting a plurality of surfaces to the conductive plates, the plurality of surfaces forming wide and narrow apertures, the narrow and wide apertures directed toward the reflective surface, portions of said plurality of surfaces having electromagnetic tapering characteristics; and disposing a substantially square waveguide feed having an opening directed toward the narrow aperture.

11. The method according to claim 10, further comprising attaching a plurality of flange extensions to the pair of conductive plates and aligned with the aperture-opening.

12. The method according to claim 11, wherein the flange extensions include electromagnetic tapering characteristics.

13. The method according to claim 11, wherein said attaching is achieved by use of at least one of the following: hinges, bolts, screws, adhesives, and weldments.

14. The method according to claim 10, wherein the plurality of surfaces are separated by a minimum of approximately one-half wavelength.

15. The method according to claim 10, wherein said surfaces are conductive.

16. The method according to claim 10, wherein said plurality of surfaces are formed of a single component of a monolithic material.

17. A communication system operating to communicate information, the communication system comprising:

a computing device;

a transmitter coupled to the computing device, the transmitter modulating data received by said computing device onto a microwave signal; and an antenna coupled to said transmitter, said antenna including a pair of substantially parallel plates coupled to a feed horn and a reflector, the feed horn having a plurality of surfaces with microwave tapering characteristics to provide for a substantially cosecant-squared elevation-plane radiation pattern for a pair of orthogonally polarized signals.

18. The communication system according to claim 17, wherein said antenna further comprises a plurality of flange extensions coupled to the pair of plates.

19. The communication system according to claim 18, wherein the flange extensions are either corrugated or absorber-lined.

20. The communication system according to claim 17, wherein the orthogonally polarized signals are communicated individually or simultaneously.

21. The system according to claim 17, wherein the microwave tapering characteristics are produced by corrugation or absorber-lining.

22. The system according to claim 17, wherein the communication system is one of an LMDS or MMDS system.

* * * * *